US006883263B1

(12) United States Patent
Carrow

(10) Patent No.: US 6,883,263 B1
(45) Date of Patent: Apr. 26, 2005

(54) ADJUSTABLE FIREARM SUPPORT SYSTEM

(76) Inventor: Michael J. Carrow, P.O. Box 663, Cache, OK (US) 73527

( * ) Notice: Subject to any disclaimer, the term of this patent is extended or adjusted under 35 U.S.C. 154(b) by 0 days.

(21) Appl. No.: 10/759,243

(22) Filed: Jan. 16, 2004

(51) Int. Cl.[7] ..... F41A 23/10

(52) U.S. Cl. ..... 42/94; 89/37.01; 89/40.06; 248/178.1

(58) Field of Search ..... 42/94; 89/37.01, 89/37.04, 37.09, 37.12, 37.13, 40.06; 211/64; 248/125.7, 125.8, 176.3, 177.1, 178.1, 186.1, 186.2; 269/159, 307, 308, 902

(56) References Cited

U.S. PATENT DOCUMENTS

| | | | | | |
|---|---|---|---|---|---|
| 3,233,517 | A | * | 2/1966 | Morrison | 89/40.06 |
| 3,703,046 | A | * | 11/1972 | Barone et al. | 42/94 |
| 4,055,017 | A | * | 10/1977 | Thompson | 42/94 |
| 4,207,699 | A | | 6/1980 | Hensley | 42/94 |
| 4,265,045 | A | * | 5/1981 | Garbini | 42/94 |
| 4,535,559 | A | | 8/1985 | Hall | 42/94 |
| 4,558,531 | A | * | 12/1985 | Kilby | 42/94 |
| 4,563,829 | A | | 1/1986 | Bozick | 42/94 |
| 4,998,944 | A | | 3/1991 | Lund | 42/94 |
| 5,070,636 | A | | 12/1991 | Mueller | 42/94 |
| 5,421,115 | A | | 6/1995 | McKay | 42/94 |
| 5,600,913 | A | | 2/1997 | Minneman | 42/94 |
| 5,685,104 | A | | 11/1997 | Breazeale, Jr. | 42/94 |
| 5,715,624 | A | | 2/1998 | Hilbelink et al. | 42/94 |
| 5,845,427 | A | | 12/1998 | Taylor | 42/94 |
| 5,937,561 | A | * | 8/1999 | Abernethy | 42/94 |
| 6,044,747 | A | * | 4/2000 | Felts | 89/40.06 |
| 6,158,159 | A | | 12/2000 | Zekas | 42/94 |
| 6,192,613 | B1 | | 2/2001 | Lantz | 42/94 |
| 6,250,009 | B1 | | 6/2001 | Leontuk | 42/72 |
| 6,272,785 | B1 | * | 8/2001 | Mika et al. | 42/94 |
| D471,248 | S | | 3/2003 | Jacobs | D22/108 |
| 6,526,687 | B1 | | 3/2003 | Looney | 42/94 |
| 6,574,899 | B1 | * | 6/2003 | Mostello | 42/94 |

FOREIGN PATENT DOCUMENTS

| | | | |
|---|---|---|---|
| AT | 45117 | * | 11/1910 |
| CH | 674569 | * | 6/1990 |
| NO | 81822 | * | 5/1953 |

OTHER PUBLICATIONS

Time Precision Inc, Introduces the New 0.22 RF Bench Rest Quality Rifle, Nov. 1996, pp 4..*

* cited by examiner

*Primary Examiner*—Michael J. Carone
*Assistant Examiner*—John Richardson

(57) ABSTRACT

An adjustable firearm support system for adjustably and accurately supporting a firearm. The adjustable firearm support system includes a base and a support unit pivotally attached to the base. The support unit pivots upon the base to adjustably support the firearm along a horizontal plane. The support unit also allows for coarse vertical adjustment of the firearm. The base includes a plurality of support members adjustably attached to the base for adjusting the vertical position of the base.

9 Claims, 10 Drawing Sheets

ADJUSTABLE FIREARM SUPPORT SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to firearm supports and more specifically it relates to an adjustable firearm support system for adjustably and accurately supporting a firearm.

2. Description of the Related Art

Firearm supports have been in use for years for aligning scopes and sights for firearms. Conventional firearm supports are typically comprised of a gun rest that is stationary and non-adjustable. The user positions the front portion of the firearm (e.g. rifle, pistol, etc.) upon the stationary firearm support and then must manually adjust the position of the firearm by moving the firearm itself.

The main problem with conventional firearm supports is that they do not allow for accurate and adjustable support of a firearm. Another problem with conventional firearm supports is that they may not be portable because of their relative large size and weight.

While these devices may be suitable for the particular purpose to which they address, they are not as suitable for adjustably and accurately supporting a firearm. Conventional firearm supports may not be adjustable nor capable of allowing fine adjustment of the position of the firearm.

In these respects, the adjustable firearm support system according to the present invention substantially departs from the conventional concepts and designs of the prior art, and in so doing provides an apparatus primarily developed for the purpose of adjustably and accurately supporting a firearm.

BRIEF SUMMARY OF THE INVENTION

In view of the foregoing disadvantages inherent in the known types of firearm supports; now present in the prior art, the present invention provides a new adjustable firearm support system construction wherein the same can be utilized for adjustably and accurately supporting a firearm.

The general purpose of the present invention, which will be described subsequently in greater detail, is to provide a new adjustable firearm support system that has many of the advantages of the firearm supports mentioned heretofore and many novel features that result in a new adjustable firearm support system which is not anticipated, rendered obvious, suggested, or even implied by any of the prior art firearm supports, either alone or in any combination thereof.

To attain this, the present invention generally comprises a base and a support unit pivotally attached to the base. The support unit pivots upon the base to adjustably support the firearm along a horizontal plane. The support unit also allows for coarse vertical adjustment of the firearm. The base includes a plurality of support members adjustably attached to the base for adjusting the vertical position of the base.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide an adjustable firearm support system that will overcome the shortcomings of the prior art devices.

A second object is to provide an adjustable firearm support system for adjustably and accurately supporting a firearm.

Another object is to provide an adjustable firearm support system that is portable and lightweight.

An additional object is to provide an adjustable firearm support system that may be utilized for various sizes and types of firearms including rifles and pistols.

A further object is to provide an adjustable firearm support system that allows for both vertical and horizontal adjustment of the line of sight for a firearm.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
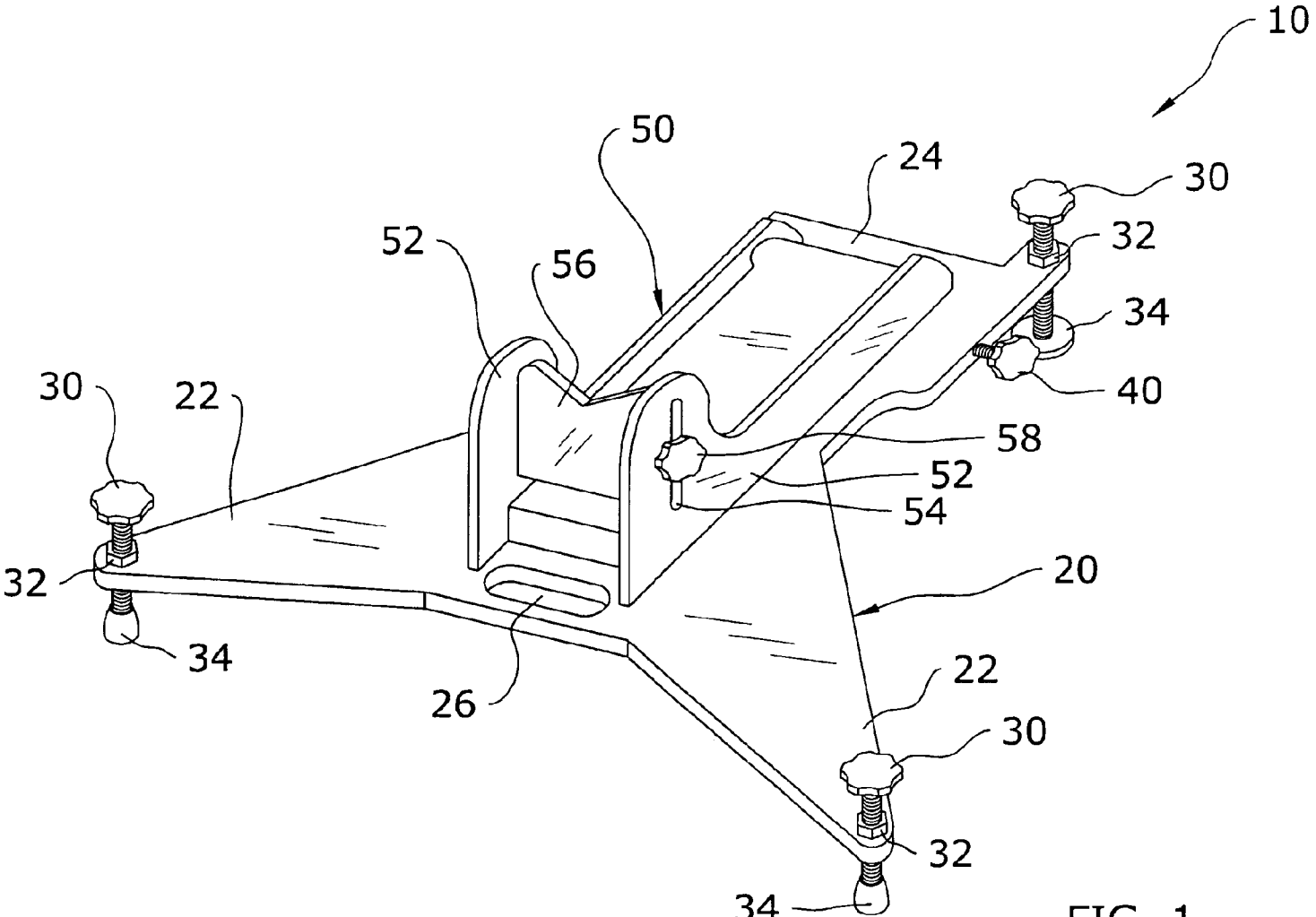
FIG. 1 is an upper perspective view of the present invention.

Turning now descriptively to the drawings, in which similar reference characters denote similar elements throughout the several views, FIGS. 1 through 10 illustrate an adjustable firearm support system 10, which comprises a base 20 and a support unit 50 pivotally attached to the base 20. The support unit 50 pivots upon the base 20 to adjustably support the firearm 14 along a horizontal plane. The support unit 50 also allows for coarse vertical adjustment of the firearm 14. The base 20 includes a plurality of support members 30 adjustably attached to the base 20 for adjusting the vertical position of the base 20.

B. Base

Figure 4:
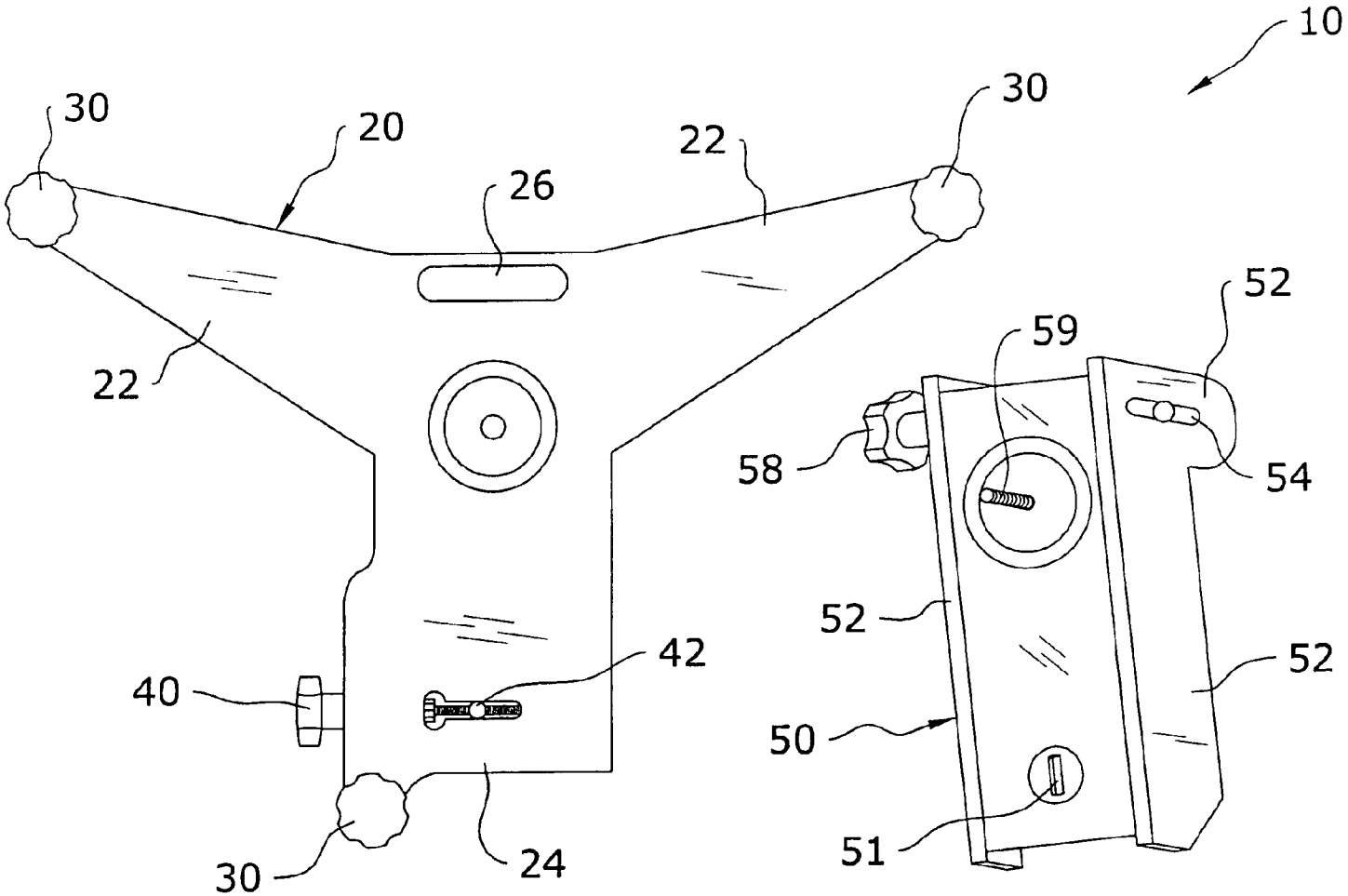
FIG. 4 is a disassembled top view of the present invention.
Figure 5:
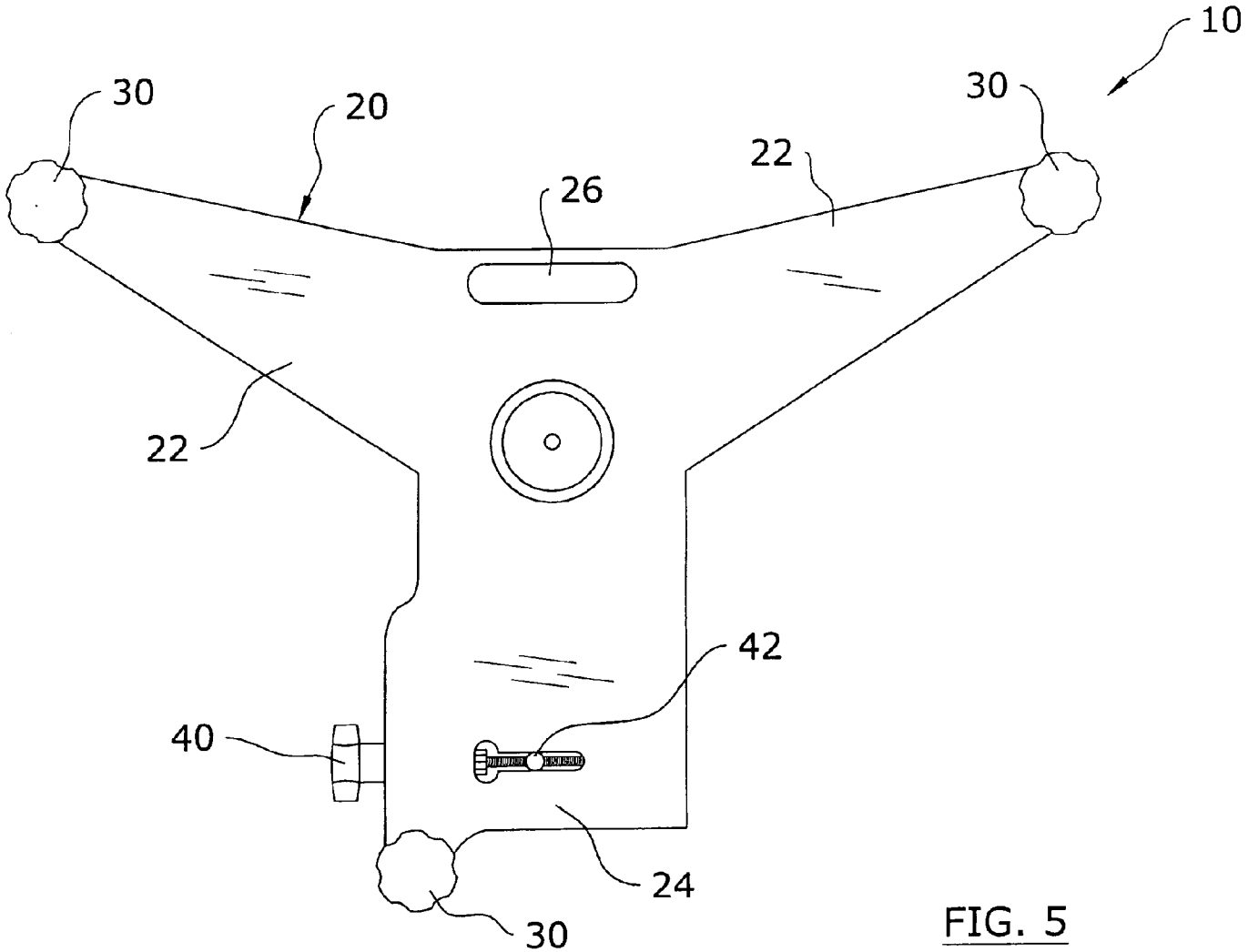
FIG. 5 is a top view of the base.

The base 20 preferably has: a front portion, a rear portion 24 and a handle opening 26 as shown in FIGS. 4 and 5 of the drawings. The base 20 preferably has a Y-shaped structure as further shown in FIGS. 4 and 5 of the drawings.

The base 20 preferably includes at least two front legs 22 extending from a front portion of the base 20. The front legs 22 each include at least one of the support members 30 as shown in FIGS. 1 through 5 of the drawings. The front legs 22 preferably extend outwardly from the base 20 at an angle as shown in FIGS. 4 and 5 of the drawings.

C. Support Members

A plurality of support members 30 are adjustably attached to the front portion and the rear portion 24 of the base 20 as shown in FIGS. 1 through 5 of the drawings. The support members 30 are preferably threadably connected to the base 20 in a vertical manner for allowing vertical adjustment of the base 20 as best shown in FIGS. 6 through 10 of the drawings. The support members 30 are each preferably comprised of a threaded shaft that is in threaded engagement with the base 20.

Figure 6:
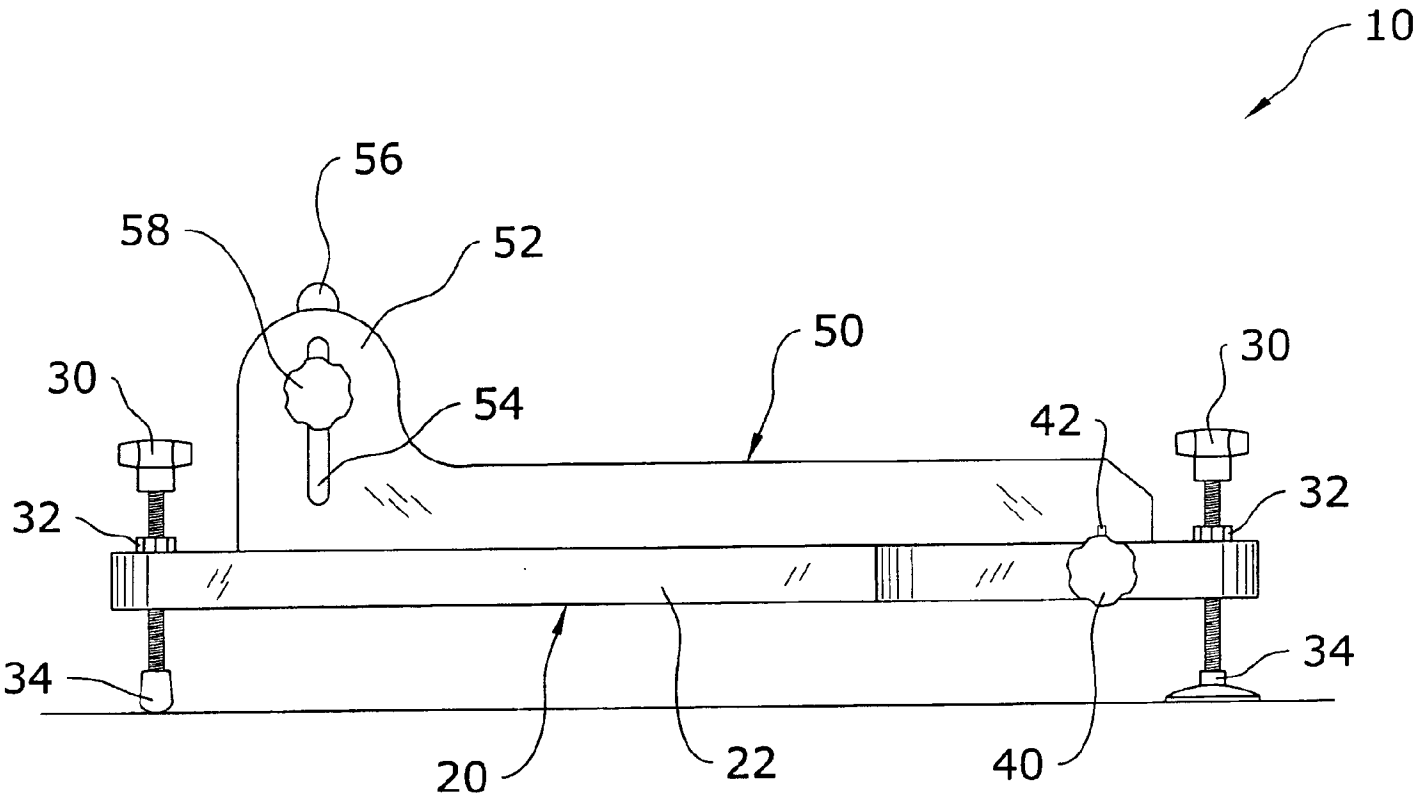
FIG. 6 is a side view of the present invention.
Figure 7:
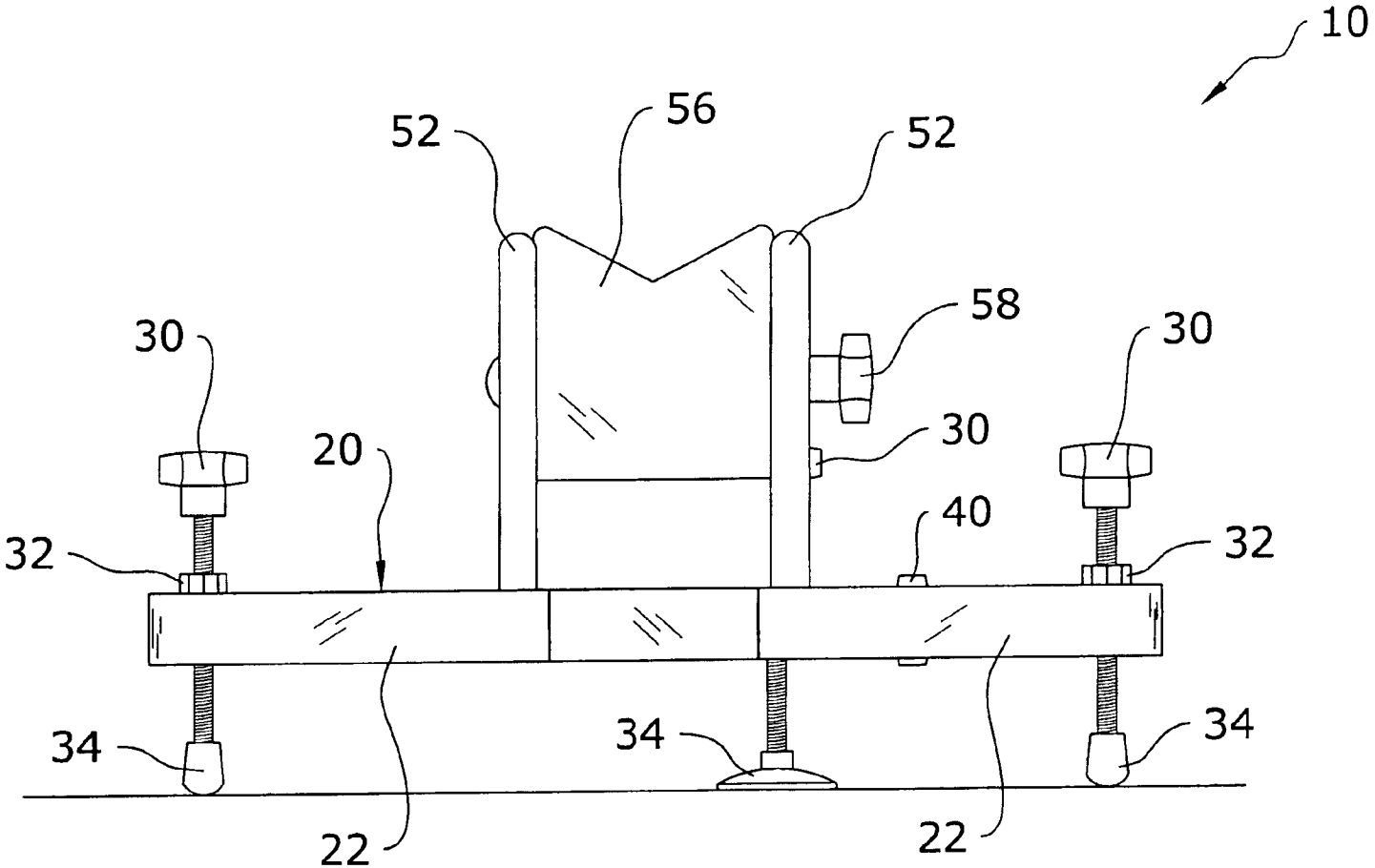
FIG. 7 is a front view of the present invention.
Figure 8:
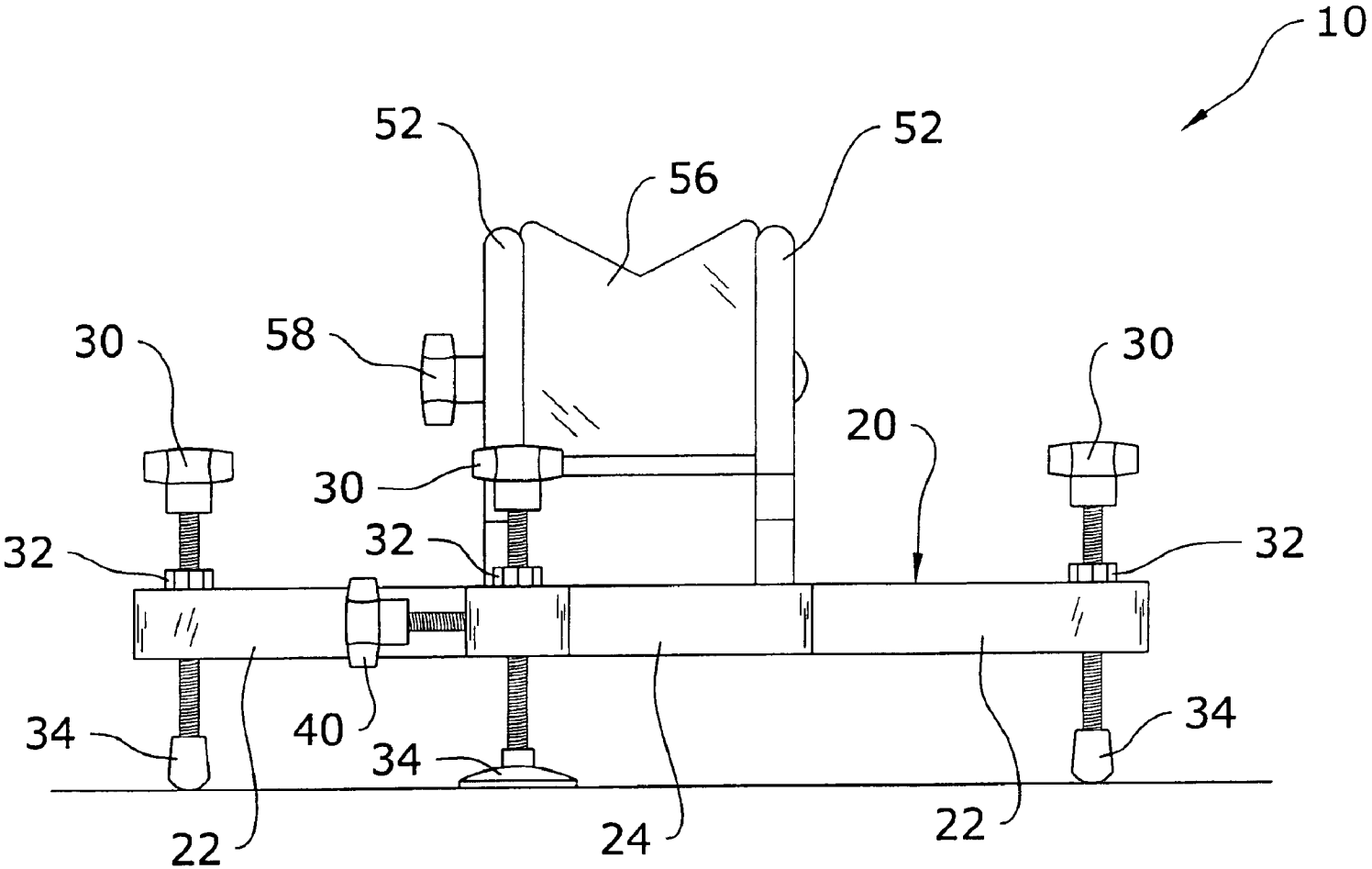
FIG. 8 is a rear view of the present invention.
Figure 9:
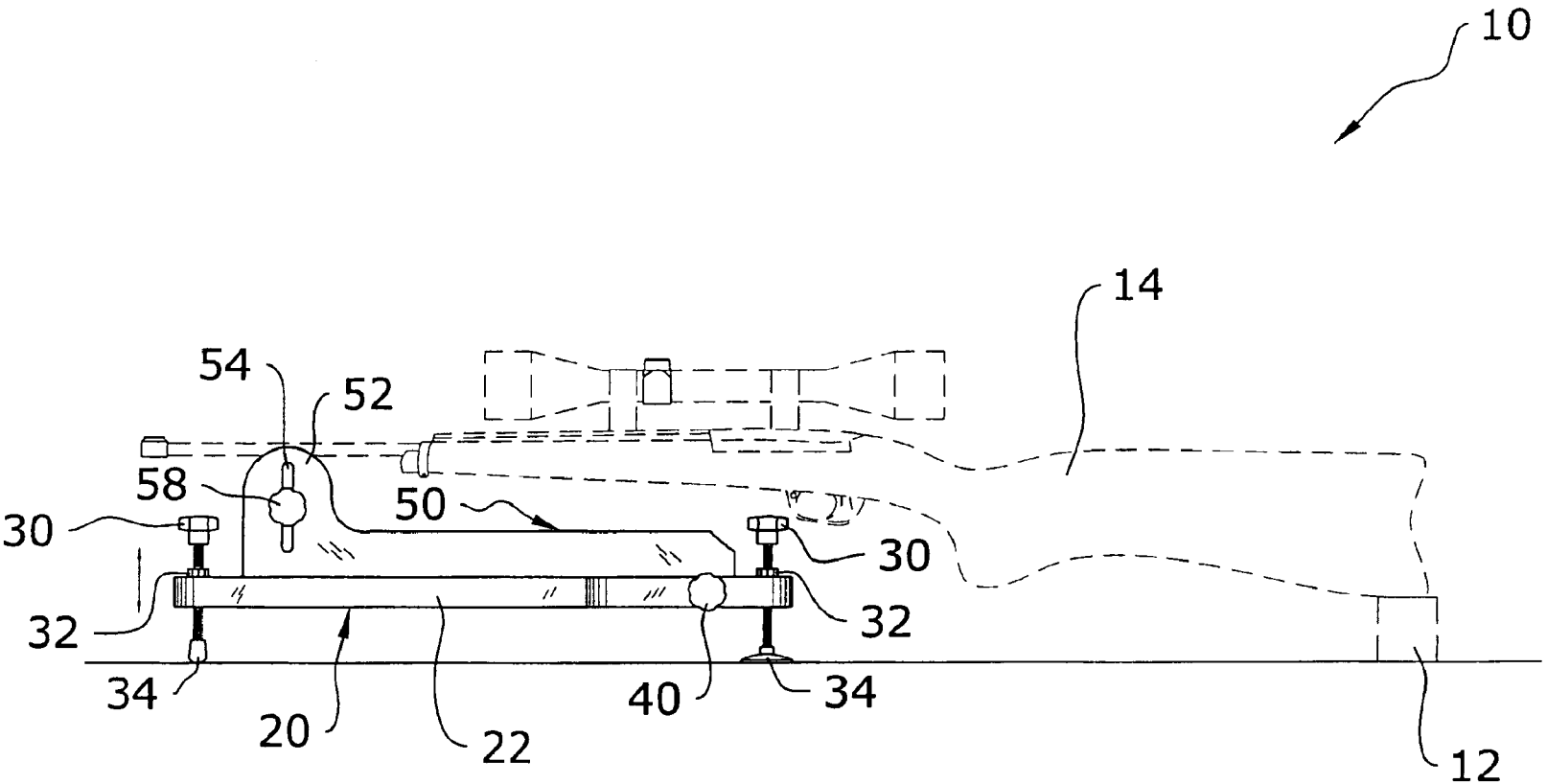
FIG. 9 is side view of the present invention supporting a rifle in a first position.
Figure 10:
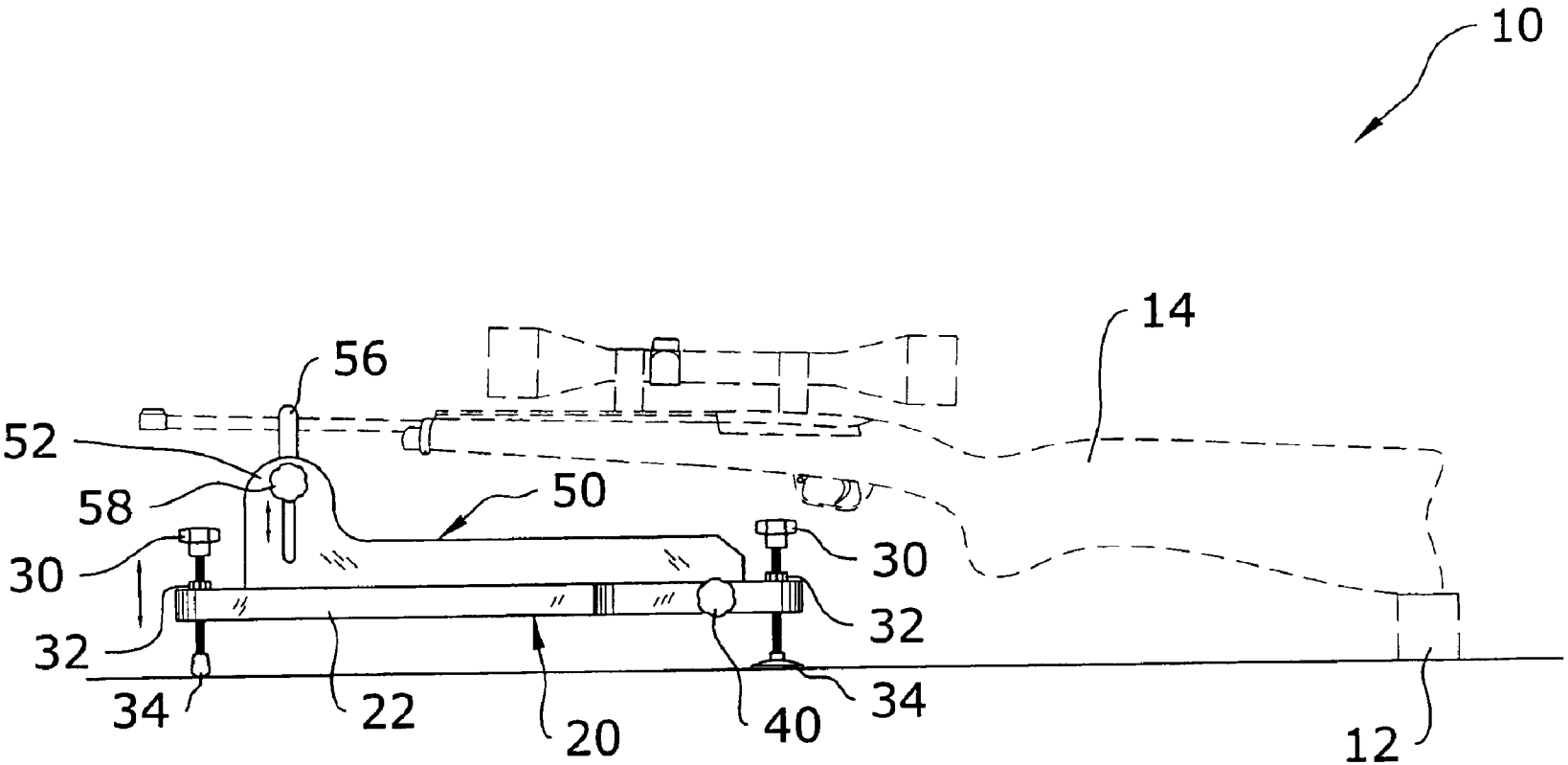
FIG. 10 is a side view of the present invention supporting a rifle in a second position.

Each of the support members 30 preferably include a locking collar 32 for selectively locking a desired vertical position with respect to the base 20 as best illustrated in FIGS. 6 through 8 of the drawings. The support members 30 each preferably include a pad member 34 for engaging a surface as illustrated in FIGS. 6 through 8 of the drawings. The support members 30 each also preferably include a handle for allowing rotation of the legs 22.

D. Support Unit

The support unit 50 is pivotally attached to the base 20 about a pivot axis. The support unit 50 is capable of supporting a firearm 14 such as a rifle or a pistol. The support unit 50 includes a pivot axle 59 that is rotatably retained within the base 20 about the pivot axis as shown in FIG. 4 of the drawings.

Figure 2:
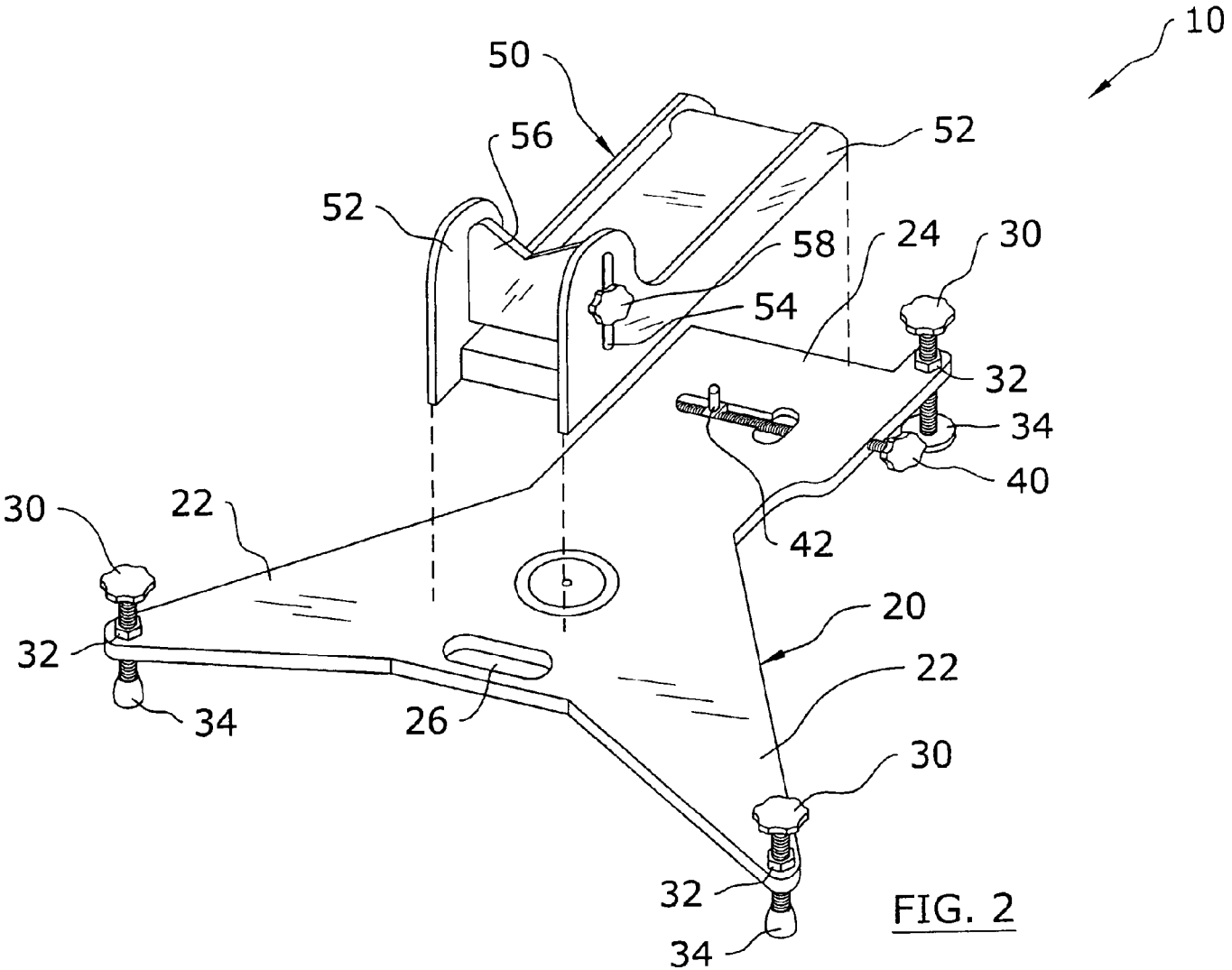
FIG. 2 is an exploded upper perspective view of the present invention.
Figure 3:
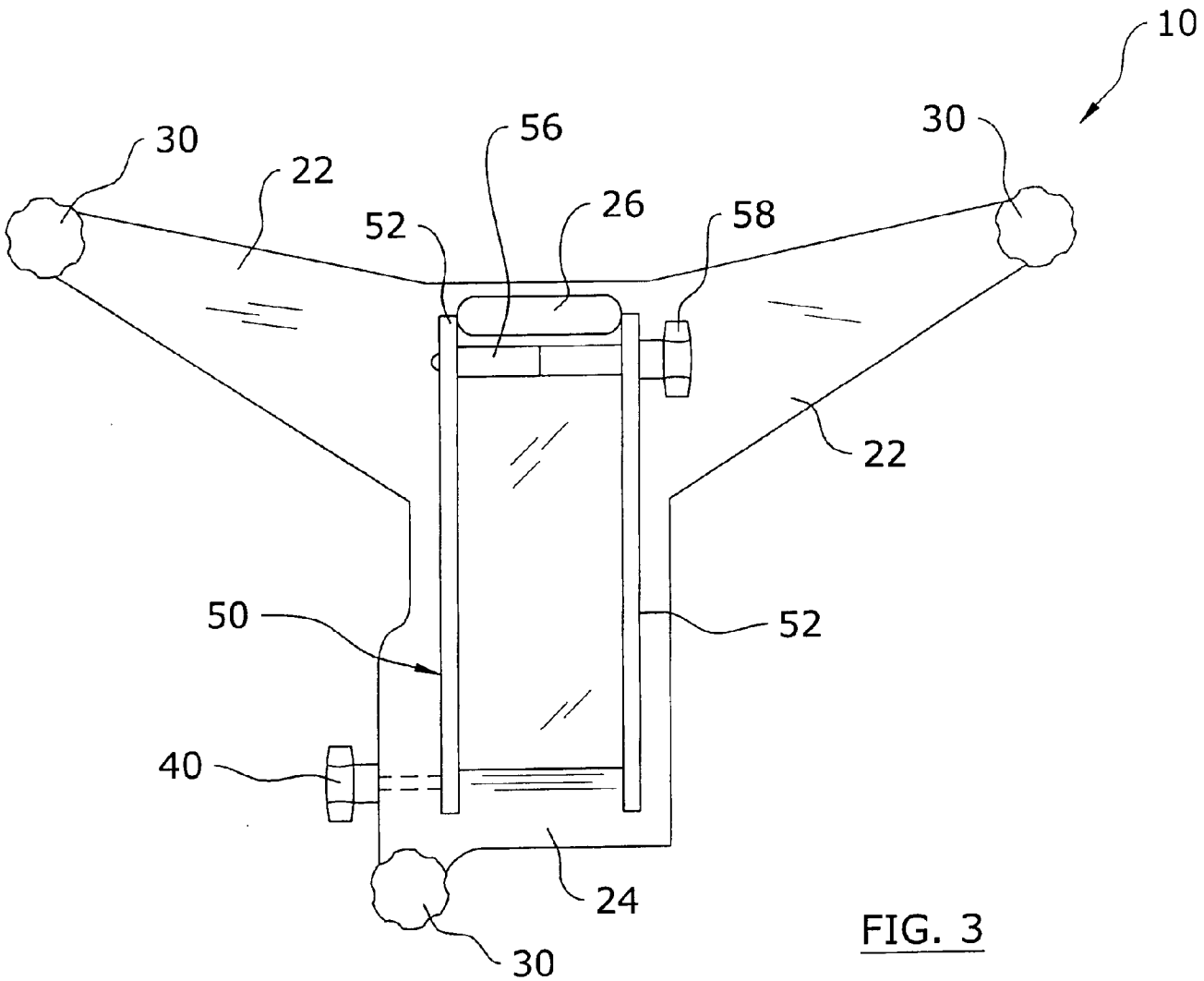
FIG. 3 is a top view of the present invention.

The support unit 50 preferably includes a pair of side members 52 and a support portion 56 movably positioned between the side members 52 as best illustrated in FIGS. 1 and 2 of the drawings. The support member is adjustable in a vertical manner for adjusting the vertical position of the front portion of a firearm 14. The support portion 56 preferably has a cutout (e.g. V-shaped, U-shaped, etc.) for receiving a firearm 14. The side members 52 each preferably include a side slot 54 that each receive a support adjuster 58 that is attached to opposing sides of the support portion 56.

E. Pivot Adjuster

The pivot adjuster 40 is attached to the base 20 and connected to a rear portion 24 of the support unit 50 for pivoting the support unit 50 about the pivot axis as shown in FIGS. 2 and 4 of the drawings. The pivot adjuster 40 preferably includes a pivot pin 42 extending upwardly that is received by a support slot 51 within the support unit 50 as shown in FIG. 4 of the: drawings. The pivot adjuster 40 is preferably comprised of a threaded shaft with a threaded collar threadably positioned upon the threaded shaft wherein the pivot pin 42 is attached to the threaded collar.

F. Operation of Invention

In use, the user positions the base 20 in a desired location. The user then positions the firearm 14 upon the support unit 50. If an elongate firearm 14 is used such as a rifle (FIGS. 9 and 10), a rear support 12 may be required to adequately support the firearm 14. The support portion 56 is vertically adjusted to a desired elevation. The user then fine tunes the vertical adjustment of the firearm 14 by adjusting one or more of the support members 30. The user may also adjust the support unit 50 along the horizontal plane by adjusting the pivot adjuster 40. After the firearm 14 is accurately aligned with a target, the user is then able to fire the firearm 14 while positioned upon the support unit 50. The user is then able to adjust the scope or sight accordingly and then repeat the above process.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. An adjustable firearm support system, comprising:

a base;

a plurality of support members adjustably attached to said base;

a support unit pivotally attached to said base about a pivot axis, wherein said support unit is capable of supporting a firearm;

a pivot axle attached to said support unit; and a pivot adjuster in the form of a threaded shaft with a threaded collar threadably positioned upon the said threaded shaft and attached to said base, and connected to a rear portion of said support unit, wherein said pivot adjuster pivotally swivels said support unit about said pivot axle by means of a pivot pit.

2. The adjustable firearm support system of claim 1, wherein said support members allow for vertical adjustment of said base.

3. The adjustable firearm support system of claim 2 wherein said support members are threadably connected to said base in a vertical manner.

4. The adjustable firearm support system of claim 3, wherein said support members each include a locking collar for locking a desired vertical position with respect to said base.

5. The adjustable firearm support system of claim 3, wherein said support members each include a handle for allowing rotation of said legs.

6. The adjustable firearm support system of claim 1, wherein said pivot adjuster includes a pivot pin extending upwardly that is received by a support slot within said support unit.

7. The adjustable firearm support system of claim 6, wherein said pivot adjuster is comprised of a threaded shaft with a threaded collar threadably positioned upon said threaded shaft and wherein said pivot pin is attached to said threaded collar.

8. The adjustable firearm support system of claim 1, wherein said base has a Y-shaped structure.

9. An adjustable firearm support system, comprising:

a base including a front portion, a rear portion and a handle opening, wherein said base has a Y-shaped structure; forming leg portions extending from a front portion of the said base;

a plurality of support members adjustably attached to said front portion and said rear portion of said base, wherein said support members are threadably connected to said base in a vertical manner for allowing vertical adjustment of said base, wherein each of said support members includes a locking collar for selectively locking a desired vertical position with respect to said base, wherein said support members each include a pad member for engaging a surface and wherein said support members each include a handle for allowing rotation of said legs;

at least two front legs extending from a front portion of said base, wherein said front legs each include at least one of said support members and wherein said front legs extend outwardly from said base at an angle;

a support unit pivotally attached to said base about a pivot axis, wherein said support unit is capable of supporting a firearm, wherein said support unit includes a pivot axle that is rotatably retained within said base about said pivot axis, wherein support unit includes a pair of side members and a support portion movably positioned, between said side members, wherein said support member is adjustable in a vertical manner and wherein said support portion has a cutout for receiving a firearm and wherein said side members each include a side slot that each receive a support adjuster that is attached to opposing sides of said support portion;

a pivot adjuster attached to said base and connected to a rear portion of said support unit for pivoting said support unit about said pivot axis, wherein said pivot adjuster includes a pivot pin extending upwardly that is received by a support slot within said support unit, and wherein said pivot adjuster is comprised of a threaded shaft with a threaded collar threadably positioned upon said threaded shaft and wherein said pivot pin is attached to said threaded collar.

* * * * *